United States Patent [19]

Nakamura et al.

[11] Patent Number: 4,594,308

[45] Date of Patent: Jun. 10, 1986

[54] PHOTOGRAPHIC ELEMENT COMPRISING SULFINIC ACID/IMIDAZOLE POLYMER MORDANT

[75] Inventors: Taku Nakamura; Akira Hibino; Takeshi Shibata; Koichi Nakamura, all of Kanagawa, Japan

[73] Assignee: Fuji Photo Film Co., Ltd., Kanagawa, Japan

[21] Appl. No.: 676,987

[22] Filed: Nov. 30, 1984

[30] Foreign Application Priority Data

Nov. 30, 1983 [JP] Japan ..... 58-226497

[51] Int. Cl.[4] ..... G03C 1/40; G03C 5/54

[52] U.S. Cl. ..... 430/213; 430/941; 525/281; 526/263; 526/286

[58] Field of Search ..... 430/213, 518, 941; 526/263, 286; 525/281; 428/500

[56] References Cited

U.S. PATENT DOCUMENTS

| | | | |
|---|---|---|---|
| 4,273,853 | 6/1981 | Ponticello et al. | 430/213 |
| 4,282,305 | 8/1981 | Brust et al. | 430/213 |
| 4,294,921 | 10/1981 | Yamaguchi et al. | 430/621 |
| 4,352,873 | 10/1982 | Toda et al. | 430/551 |
| 4,358,534 | 11/1982 | Sasaki et al. | 430/551 |
| 4,450,224 | 5/1984 | Klein et al. | 430/213 |

*Primary Examiner*—Richard L. Schilling

*Attorney, Agent, or Firm*—Sughrue, Mion, Zinn, Macpeak, and Seas

[57] ABSTRACT

A photographic element containing, as a mordant, a polymer comprising a monomer unit having at least an imidazole ring and a monomer unit having at least a sulfinic acid group. The mordant provides dye images of high transfer density and improves fastness of the dye images to light or high temperature and humidity.

16 Claims, No Drawings

PHOTOGRAPHIC ELEMENT COMPRISING SULFINIC ACID/IMIDAZOLE POLYMER MORDANT

FIELD OF THE INVENTION

This invention relates to a polymer mordant and a photographic element using the same. More particularly, this invention relates to a mordant for fixing an imagewige produced diffusible dye and a color photographic element using a layer containing the mordant.

BACKGROUND OF THE INVENTION

In the photographic field, it has been known to use a quaternary ammonium salt polymer as a mordant for fixing anionic dyes as disclosed in U.S. Pat. Nos. 3,709,690, 3,958,995 and 3,898,088, etc. However, polymers of this type have insufficient ability to hold mordanted dyes in a stable form, though exhibiting satisfactory mordanting property for dyes. In other words, photographic systems involving dye images mordanted by these polymer mordants suffer from a disadvantage in that mordanted dye images are susceptible to chemical change or decomposition due to irradiation with fluorescence or sunlight, etc.

On the other hand, British Pat. No. 2,056,101 and U.S. Pat. Nos. 4,115,124, 4,282,305 and 4,273,853, etc. disclose polymers having a tertiary imidazole ring in their side chains. Although these polymers have a property to maintain the mordanted dyes in a stable form against light, there is a problem that the mordanted dyes are susceptible to chemical change or decomposition due to temperature or humidity changes. In other words, dyes mordanted by these polymers are apt to discolor under high temperature and humidity conditions.

Furthermore, most of the conventional polymer mordants are water-soluble and diffusible into an image-receiving layer or a layer adjacent thereto, thus causes smearing of images.

SUMMARY OF THE INVENTION

An object of this invention is to provide a photographic element which has a good mordanting property for dyes and affords high transferred dye image densities.

Another object of this invention is to provide a photographic element wherein a mordanted dye image is less discolored due to light, high temperature and humidity.

A further object of this invention is to provide a photographic element which produces a dye image free from smearing.

These objects of the present invention can be accomplished by a photographic element in which a polymer comprising a monomer unit having at least an imidazole ring and a monomer unit having at least a sulfinic acid group is used as a mordant.

DETAILED DESCRIPTION OF THE INVENTION

The polymer which can be used in the present invention preferably contains 10 to 98 mol% of a monomer unit having an imidazole group and 2 to 40 mol% of a monomer unit having a sulfinic acid group.

Preferred examples of the polymer which can be used in the present invention are those comprising a monomer unit having an imidazole group represented by the formula (I) and a monomer unit having a sulfinic acid group represented by the formula (II):

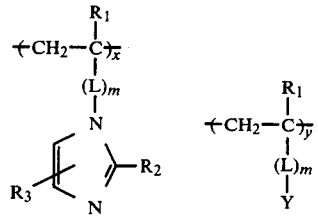

(I) (II)

wherein $R_1$, $R_2$ and $R_3$ each represents a hydrogen atom or an alkyl group having 1 to 6 carbon atoms; L represents a divalent linking group having 1 to 20 carbon atoms; m represents 0 or 1; Y represents a sulfinic acid group or a sulfinic acid group in the form of a salt; x represents 10 to 98 mol%; and y represents 2 to 40 mol%.

The monomer unit represented by the formula (I) is a monomer unit formed by copolymerizing an ethylenically unsaturated monomer having an imidazole ring. In the above-described formula (I), $R_1$, $R_2$ and $R_3$ each specifically represents a hydrogen atom, a methyl group, an ethyl group, a hydroxyethyl group, an n-propyl group, an n-butyl group, an n-amyl group, an n-hexyl group, etc., with a hydrogen atom, a methyl group and an ethyl group being preferred.

Specific examples of L include an alkylene group (e.g., a methylene group, an ethylene group, a trimethylene group, a hexamethylene group, etc.) a phenylene group (e.g., an o-phenylene group, a p-phenylene group, an m-phenylene group, etc.), an arylene-alkylene group

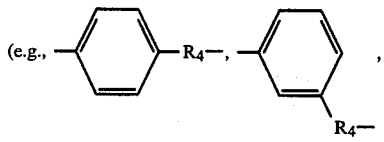

etc., wherein $R_4$ represents an alkylene group having 1 to 12 carbon atoms), $—CO_2—$, $—CO_2—R_5—$ (wherein $R_5$ represents an alkylene group, a phenylene group or an arylenealkylene group), $—CONH—R_5—$ (wherein $R_5$ is as defined above) and

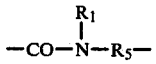

(wherein $R_1$ and $R_5$ are as defined above). Of these,

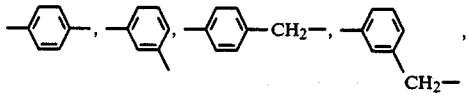

$—CO_2—$, $—CONH—$, $—CO_2CH_2CH_2—$, $—CO_2CH_2CH_2CH_2—$, $—CONHCH_2—$, $—CONHCH_2CH_2$, $—CONHCH_2CH_2CH_2—$, etc. are particularly preferred.

Specific examples of the monomer unit represented by the formula (I) which can preferably be used in the present invention are shown below:

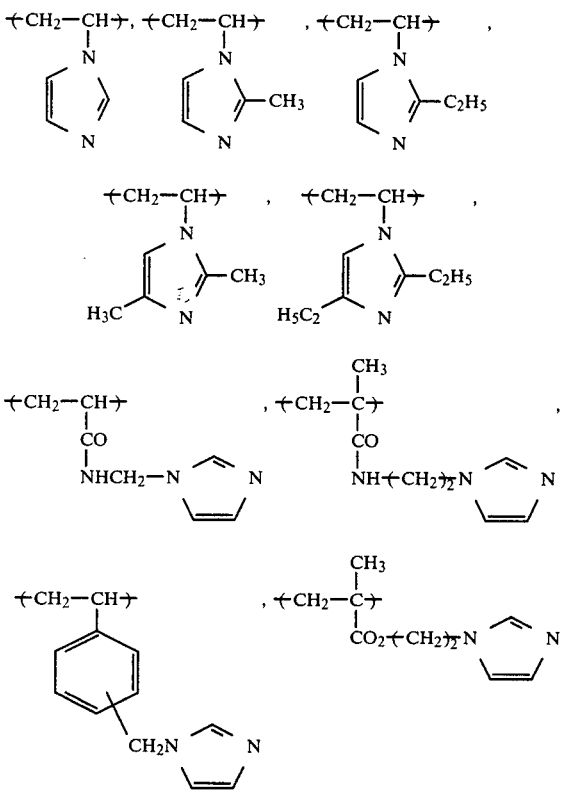

In the above-described formula (I), x represents 10 to 98 mol%, preferably 40 to 98 mol%, and more preferably 50 to 90 mol%.

The monomer unit represented by the above formula (II) is a monomer unit formed by copolymerizing an ethylenically unsaturated monomer having a sulfinic acid group or a sulfinic acid salt.

In the formula (II), $R_1$ and L have the same meanings as described for the formula (I). More specifically, $R_1$ preferably represents a hydrogen atom or a methyl group, and L preferably represents

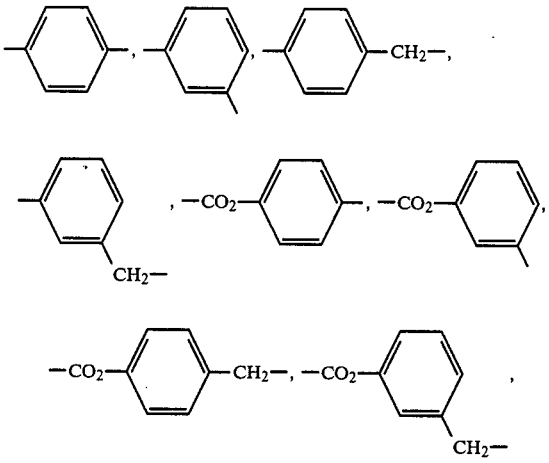

-continued

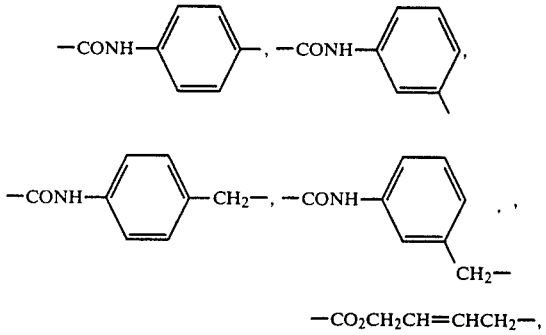

or $-CONHCH_2CH{=}CHCH_2-$.

Y represents a sulfinic acid group or a sulfinic acid group in the form of a salt. The cation which forms the sulfinic acid salt is preferably mono-, di- or trivalent. When the cation is divalent or higher-valent, the counter anion or anions may be those other than the monomer unit represented by the formula (II). Preferred cations include an ammonium ion and a metal ion, with a metal ion (e.g., a sodium ion or potassium ion) being particularly preferred.

Specific examples of the monomer unit (II) which can be preferably used in the present invention are shown below:

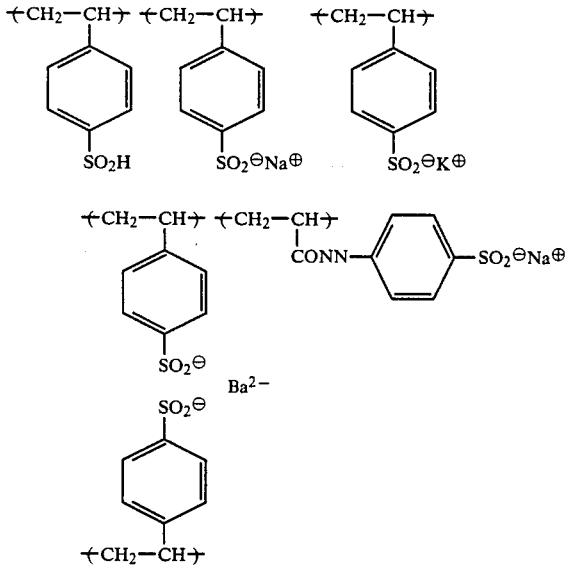

In the above-described formula (II), y represents about 2 to about 40 mol%, preferably 2 to 30 mol%, and more preferably 5 to 25 mol%.

The polymer used in the present invention may further contain monomer units formed by copolymerizing other ethylenically unsaturated monomers in addition to the monomer units (I) and (II). When such monomers are used, it is preferable that the proportion of the additional monomer units does not exceed about 60 mol%.

Any ethylenically unsaturated monomer which is addition polymerizable can be used. Examples of such monomers include acrylic esters, such as methyl methacrylate, butyl acrylate, butyl methacrylate and ethyl acrylate; vinyl esters such as vinyl acetate; amides, such as acrylamide, diacetone acrylamide, N-methyl acrylamide and methacrylamide; nitriles, such as acrylonitrile and vinylphenylacetonitrile; ketones, such as methyl vinyl ketone, ethyl vinyl ketone and p-vinylacetophenone; halides, such as vinyl chloride, vinylidene chloride and vinylbenzyl chloride; ethers, such as methyl vinyl ether, ethyl vinyl ether and vinylbenzyl methyl ether; $\alpha,\beta$-unsaturated acids such as acrylic acid and methacrylic acid and other unsaturated acids such as vinylbenzoic acid; simple heterocyclic monomers such as vinylpyridine vinylpyrrolidone; olefins, such as ethylene, propylene butylene and styrene as well as substituted styrene; diolefins, such as butadiene and 2,3-dimethylbutadiene and the like, and other vinyl monomers which are well known in the art.

The polymer according to the present invention preferably has a molecular weight of from $5\times10^3$ to $1\times10^7$. If the molecular weight is too small, the polymer tends to move. On the other hand, too large a molecular weight sometimes causes troubles in coating. A particularly preferred molecular weight ranges from $1\times10^4$ to $2\times10^6$.

Preferred examples of the polymers which can be used in the present invention are shown below:

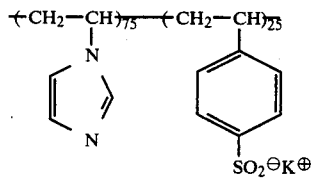

P-1

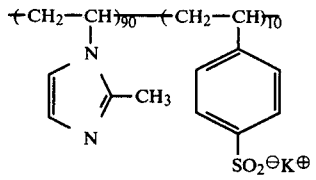

P-2

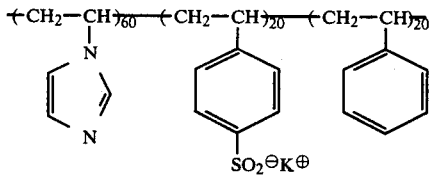

P-3

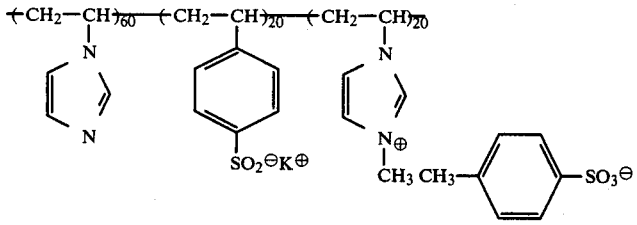

P-4

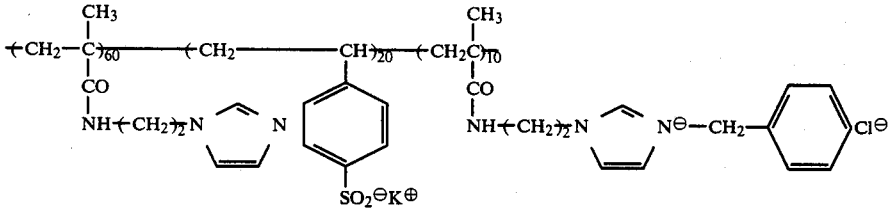

P-5

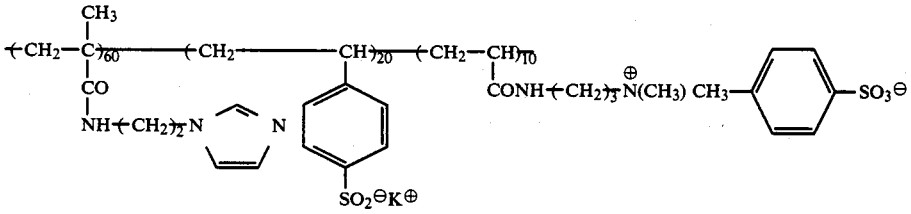

P-6

-continued

P-7

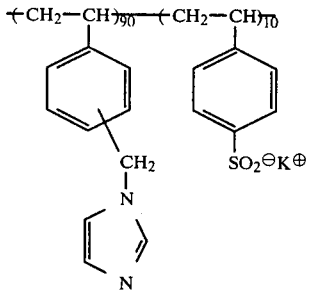

A process for producing the polymers of the present invention is described below by way of Synthesis Examples.

SYNTHESIS EXAMPLE 1

Synthesis of Polymer P-1

In a 300 ml-volume three-necked flask were charged 42.4 g of 1-vinylimidazole, 10.5 g of potassium vinylbenzenesulfonate and 52.9 g of distilled water, and the mixture was adjusted to pH 8.85 with concentrated hydrochloric acid. After thoroughly displacing the atmosphere with nitrogen gas, the mixture was heated to 60° C. When the temperature of the mixture became constant, 0.26 g of 2,2'-azobis(2-amidinopropane)hydrochloride was added thereto, and the heating was continued for 7 hours. The reaction mixture was cooled to room temperature and subjected to dialysis against tap water using a semipermeable membrane for 60 hours. Freeze-drying gave 22.4 g (42.3%) of poly(1-vinylimidazole-co-potassium vinylbenzenesulfinate) (Polymer P-1) having an intrinsic viscosity [η] of 0.30 (1% NaCl aqueous solution, 30° C.).

SYNTHESIS EXAMPLE 2

Synthesis of Polymer P-4

In a 300 ml-volume three-necked flask were charged 37.7 g of 1-vinylimidazole, 14.0 g of 1-vinyl-3-methylimidazolium-p-toluenesulfonate, 10.5 g of potassium vinyllbenzenesulfinate, 62.2 g of dimethylformamide and 10.0 g of distilled water. The atmosphere was thoroughly displaced with nitrogen gas, and the mixture was heated to 60° C. When the temperature of the mixture became constant, 0.31 g of 2,2'-azobis(2,4-dimethylvaleronitrile) was added thereto, and the heating was continued for 6.5 hours. After cooling to room temperature, the reaction mixture was subjected to dialysis against tap water for 60 hours using a semipermeable membrane. The non-dialyzable liquid was freeze-dried to obtain 16.2 g (26.0%) of poly(1-vinylimidazole-co-potassium vinylbenzenesulfinate-co-1-vinyl-3-methylimidazolium-p-toluenesulfonate) (P-4) having an intrinsic viscosity [η] of 0.13 (1% NaCl aqueous solution, 30° C.).

The polymer of the present invention can be used in a mordant layer individually or in combination with a binder. Hydrophilic binders can be used to this effect. The hydrophilic binders typically include transparent or semi-transparent hydrophilic colloids, such as natural substances, e.g., proteins (e.g., gelatin, gelatin derivatives), cellulose derivatives, and polysaccharides (e.g., starch, gum arabic); and synthetic polymeric substances, e.g., polyvinyl alcohol, polyvinylpyrrolidone, polyacrylamide, etc. Among these binders, gelatin and polyvinyl alcohol are particularly useful.

A mixing ratio of the polymer mordant of the present invention to the binder and the coverage of the polymer mordant can easily be determined by those skilled in the art depending on the amounts of dyes to be mordanted, types or compositions of the polymer mordant, image-forming processes to be used, and the like. Usually, the ratio of the mordant to binder ranges from 20:80 to 80:20 by weight, and the coverage of the mordant ranges from 0.2 to 15 g/m$^2$, and preferably from 0.5 to 8 g/m$^2$.

The mordant layer containing the mordant according to the present invention can contain various surface active agents for the purpose of ensuring coating properties and the like.

The polymer of the present invention can be used in combination with a gelatin hardening agent in the mordant layer.

The gelatin hardening agent which can be used in the present invention can include aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, bis(vinylsulfonyl)methyl ether, N,N'-ethylene bis(vinylsulfonylacetamide), etc.), active halogen compounds (e.g., 2,4-dichloro-6-hydroxy-s-triazine, etc.), mucohalogenic acids (e.g., mucochloric acid, mucophenoxychloric acid, etc.), isoxazoles, dialdehyde starch, and the like. Specific examples of these gelatin hardening agents are given in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,837, 3,490,911, 3,593,644 and 3,543,292, British Pat. Nos. 676,628, 825,544 and 1,270,578, German Pat. Nos. 872,153, 1,090,427 and 2,749,260, Japanese Patent Publication Nos. 7133/59 and 1872/71, etc.

Of these gelatin hardeners, aldehydes, active vinyl compounds and active halogen compounds are particularly preferred.

These hardeners may be added directly to a coating composition for a mordant layer, or may be added to other coating compositions so as to be diffused into a mordant layer in the course of coating in layers.

The amount of the gelatin hardener to be used can arbitrarily be selected depending on the end use. Usually, it is in the range of from 0.05 to 10 mols, and preferably 0.1 to 1.0 mol, per mol of sulfinic acid in the polymer used in the present invention.

When the polymer of this invention is used as a mordant, metal ions can be used in combination in a dye-fixing material to increase the densities of transferred dyes.

The metal ion is added to a mordant layer containing the mordant or an upper or lower layer adjacent thereto. The metal ion to be used is preferably colorless and stable against heat and light. More specifically, polyvalent ions of transition metals, e.g., $Cu^{2+}$, $Zn^{2+}$, $Ni^{2+}$, $Pt^{2+}$, $Pd^{2+}$, $Co^{3+}$, etc., are preferred, with $Zn^{2+}$ being more preferred. Such a metal ion is usually added in the form of a water-soluble compound, such as $ZnSO_4$ and $Zn(CH_3CO_2)_2$, in an amount of from 0.01 to 5 g/m$^2$, and preferably from 0.1 to 1.5 g/m$^2$.

The layer to which such a metal ion is added can contain a hydrophilic polymer as a binder. Typical hydrophilic binders usable are transparent or semitransparent hydrophilic colloids, including natural substances, such as proteins, e.g., gelatin, gelatin derivatives, etc., cellulose derivatives, polysaccharides, e.g., starch, gum arabi, etc., and synthetic polymeric substances, such as water-soluble polyvinyl compounds, e.g., polyvinyl alcohol, polyvinylpyrrolidone, polyacrylamide, etc. Of these, gelatin and polyvinyl alcohol are particularly useful.

Image-forming dyes which are mordanted by the mordant layer of the present invention include azo dyes, azomethine dyes, anthraquinone dyes, naphthoquinone dyes, styryl dyes, nitro dyes, quinoline dyes, carbonyl dyes and phthalocyanine dyes having an anionic group, e.g., a phenolic hydroxy group, a sulfonamido group, a sulfonic acid group, a carboxyl group, etc.

The mordant layer according to the present invention can be used to fix dyes in a color image formation process in which diffusible dyes are imagewise formed and then diffused, followed by fixing.

The above-mentioned color image formation process can be embodied by various systems, for example, a system of using a developing solution at temperatures around room temperature as described in Bergian Pat. No. 757,959, and a system of making use of heat development as described in Japanese Patent Application OPI Nos. 58543/83 and 79247/83, and the mordant layer of the present invention can be used in any of these systems.

Photographic elements using the mordant layer of the present invention will hereinafter be described in detail.

The photographic element containing the mordant of this invention usually comprises (1) a support, (2) a light-sensitive element and (3) an image-receiving element. Developing methods include heat development and development using a developing solution. In any developing method, the photographic element is exposed to light, and silver halides are developed while imagewise forming diffusible dyes, are then transferred to an image-receiving element.

The above-described photographic element can further contain a developing agent, an assistant developing agent and a processing element.

One preferred example of the above-described embodiment is disclosed in Belgian Pat. No. 757,959. Another preferred embodiment wherein the mordant of the present invention can be used is described in U.S. Pat. Nos. 3,415,644, 3,415,645, 3,415,646, 3,647,487 and 3,635,707, German Patent Application (OLS) No. 2,426,980, etc.

Still another embodiment of using the mordant of the present invention, which is the most preferred, involves heat development and is described in Japanese Patent Application (OPI) Nos. 58543/83 and 79247/83 (EPC Pat. Nos. 76,492 and 79,056, respectively) and Japanese Patent Application Nos. 149046/83 and 149047/83.

The present invention will now be illustrated in greater detail with reference to examples. In these examples, all percents are given by weight unless otherwise indicated.

EXAMPLE 1

Preparation of Silver Iodobromide Emulsion

In 3,000 ml of water were dissolved 40 g of gelatin and 26 g of potassium bromide, and the solution was kept at 50° C. with stirring. A solution of 34 g of silver nitrate in 200 ml of water was then added to the above solution. Thereafter, a solution of 3.3 g of potassium iodide in 100 ml of water was added thereto dropwise over 2 minutes. Excess of salts was precipitated by pH-adjustment and removed. The resulting emulsion was adjusted to pH 6.0 to obtain 400 g of a silver iodobromide emulsion.

Preparation of Silver Benzotriazole Emulsion

In 3,000 ml of water were dissolved 28 g of gelatin and 13.2 g of benzotriazole, and the solution was kept at 40° C. with stirring. To the resulting solution was added dropwise a solution of 17 g of silver nitrate in 100 ml of water over 2 minutes.

Excess of salts was precipitated by pH-adjustment and removed. The resulting emulsion was adjusted to pH 6.0 to obtain 400 g of a silver benzotriazole emulsion.

Preparation of Gelatin Dispersion of Dye-Donating Compound

Five grams of a cyan dye-donating compound having the following structure, 0.5 g of sodium succinic acid-2-ethylhexyl ester sulfonate and 5 g of tricresyl phosphate were weighed and mixed with 30 ml of ethyl acetate to form a uniform solution by heating at about 60° C. The solution was then mixed with 100 g of a 10% aqueous solution of lime-processed gelatin and dispersed by the use of a homogenizer at 10,000 rpm for 10 minutes. The resulting dispersion was designated as a dispersion of a dye-donating compound (cyan).

Cyan Dye-Donating Compound:

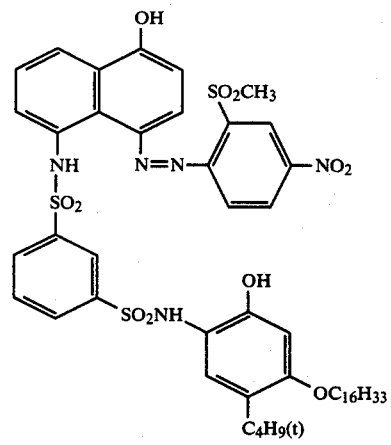

Preparation of Light-sensitive Coating

The following components were mixed and dissolved, and the resulting composition was coated on a polyethylene terephthalate film to a wet thickness of 30 μm, followed by drying:

(a) Silver benzotriazole emulsion: 10 g
(b) Silver iodobromide emulsion: 20 g
(c) Dispersion of dye-donating compound (cyan): 33 g (d) 5% Aqueous solution of

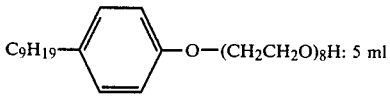

(e) 10% Ethanolic solution of guanidinotrichloroacetic acid: 12.5 ml (f) 10% Aqueous solution of $H_2NSO_2N(CH_3)_2$: 4 ml (g) Water: 7.5 ml A composition comprising the following components was then coated thereon as a protecting layer to a dry thickness of 25 μm and dried:

(h) 10% Aqueous solution of gelatin: 35 g.

(i) 10% Ethanolic solution of guanidinotrichloroacetic acid: 5 ml (j) 1% Aqueous solution of sodium succinic acid-2-ethylhexyl ester sulfonate: 4 ml (k) Water: 56 ml Preparation of Dye-Fixing Material Eight grams of Mordant HP-1 having the following structure was diluted with 200 ml of distilled water and uniformly mixed with 100 g of a 10% lime-processed gelatin aqueous solution. The resulting mixture was uniformly applied onto a paper support laminated with polyethylene having dispersed therein titanium diacetate to a wet thickness of 900 μm. After drying, the resulting sample was used as Dye-Fixing Material (A) containing Mordant HP-1.

Further, Dye-Fixing Material (B) was prepared in the same manner as described above except for using Mordant HP-2 having the following structure in place of HP-1.

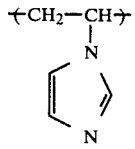

Mordant HP-1

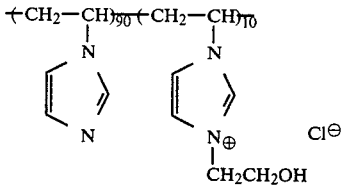

Mordant HP-2

A dye-fixing material wherein the mordant of the present invention (P-1) was used in place of the above used mordant HP-1 or HP-2 was prepared as follows:

To a mixture consisting of 0.75 g of Gelatin Hardener H-1, 0.25 g of Gelatin Hardener H-2 and 160 ml of distilled water was added 100 g of a 10% acid-processed gelatin aqueous solution, followed by uniformly mixing. The resulting mixture was uniformly coated onto a paper support laminated with polyethylene having dispersed therein titanium oxide to a wet thickness of 60 μm and dried. Then, 10 g of Mordant P-1 and 200 ml of distilled water was added thereto, and 100 of a 10% aqueous solution of lime-processed gelatin was further added thereto, followed by uniformly mixing. The resulting mixture was coated uniformly on the above-obtained coated layer and dried. The resulting sample was designated as Dye-Fixing Material (C) containing Mordant P-1.

Dye-Fixing Material (D) was prepared in the same manner as described above but using Mordant P-7 instead of P-1.

Gelatin Hardener H-1:

$CH_2{=}CHSO_2CH_2CONHCH_2CH_2NHCOCH_2SO_2CH{=}CH_2$

Gelatin Hardener H-2:

$CH_2{=}CHSO_2CH_2CONHCH_2CH_2CH_2NHCOCH_2SO_2CH{=}CH_2$

Each of the above prepared light-sensitive coatings was imagewise exposed to light for 10 seconds using a tungsten lamp at 2,000 lx and then uniformly heated for 30 seconds on a heating block heated at 130° C. After supplying 80 ml of water per $m^2$ of the coating film side of the dye-fixing material, the heat-treated light-sensitive coating and the water-supplied dye-fixing material were brought into contact with each other, with the respective coating film sides facing to each other. After heating the system for 5 seconds on a heating block heated at 80° C., the dye-fixing material was peeled off. There was obtained a negative cyan dye image on the dye-fixing material. The density of the thus formed negative image was measured by the use of a Macbeth reflection densitometer (RD-519).

Then, onto a film surface of the dye-fixing material having thereon a negative image was superposed a transparent film having an ultraviolet absorbing layer, and was irradiated with xenon light (100,000 lx) for 3 days using Atlas C.I 65 Weather-O-meter. Color densities before and after the xenon light irradiation were measured to evaluate light-fastness of the dye image (Dye Remaining Ratio I).

The dye fixing materials having the respective negative images were allowed to stand for 7 days in dark set at 60° C. and at a relative humidity (RH) of 70%. The dye image densities before and after the standing were determined to evaluate fastness of the dye images to high temperature and high humidity (Dye Remaining Ratio II).

The maximum density and the dye remaining ratios I and II at a reflection density of 1.0 of each dye-fixing material were measured and the results are shown in Table 1.

TABLE 1

| Dye-Fixing Material | Mordant | Maximum Density | Dye Remaining Ratio (I)* (%) | Dye Remaining Ratio (II)** (%) | Remark |
|---|---|---|---|---|---|
| (A) | HP-1 | 1.80 | 64 | 70 | Comparison |
| (B) | HP-2 | 1.92 | 54 | 73 | " |
| (C) | P-1 | 2.00 | 66 | 99 | Invention |
| (D) | P-4 | 2.10 | 52 | 99 | " |

Note:

$$\text{*Dye Remaining Ratio (I)} = \frac{\text{Color Density After 3-Day Irradiation with Xenon Light}}{\text{Color Density Before Irradiation}} \times 100$$

$$\text{**Dye Remaining Ratio (II)} = \frac{\text{Color Density After 7-Day Standing in Dark (60° C., RH 70%)}}{\text{Color Density Before Standing}} \times 100$$

It can be seen from Table 1 that the mordants according to the present invention provide cyan dye images of high densities and markedly improve fastness of the transferred dye images under high temperature and humidity conditions.

It has also been found that the mordants of the present invention greatly improve sharpness of the transferred dye images.

EXAMPLE 2

The same procedures as described in Example 1 were repeated except that the cyan-dye-donating compound in the light-sensitive coating was replaced by a dye-donating compound having the following structure. The results obtained are shown in Table 2.

Magenta Dye-Donating Compound:

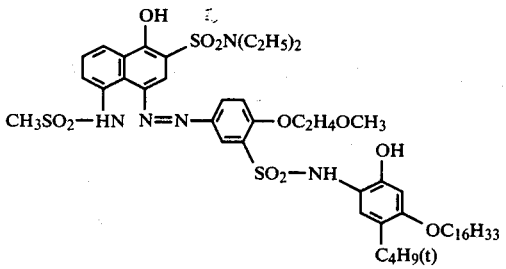

TABLE 2

| Dye-Fixing Material | Mordant | Maximum Density | Dye Remaining Ratio (I) (%) | Remark |
|---|---|---|---|---|
| (A) | HP-1 | 1.90 | 73 | Comparison |
| (B) | HP-2 | 1.96 | 68 | " |
| (C) | P-1 | 2.10 | 92 | Invention |
| (D) | P-4 | 2.20 | 80 | " |

It can be seen from Table 2 that the mordants of the present invention provide magenta dye images of high density and also greatly improve light-fastness of the transferred images.

EXAMPLE 3

The procedures as described in Example 1 were repeated except that the cyan dye-donating compound used in the light-sensitive coating was replaced by a yellow dye-donating compound having the following structure. The results obtained are shown in Table 3.

Yellow Dye-Donating Compound:

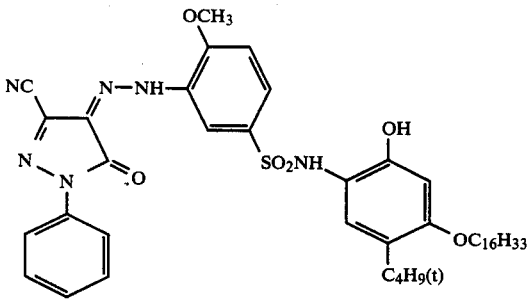

TABLE 3

| Dye-Fixing Material | Mordant | Maximum Density | Dye Remaining Ratio (I) (%) | Remarks |
|---|---|---|---|---|
| (A) | HP-1 | 1.75 | 87 | Comparison |
| (B) | HP-2 | 1.83 | 68 | Comparison |

TABLE 3-continued

| Dye-Fixing Material | Mordant | Maximum Density | Dye Remaining Ratio (I) (%) | Remarks |
|---|---|---|---|---|
| (C) | P-1 | 1.85 | 84 | Invention |
| (D) | P-4 | 1.93 | 70 | Invention |

As shown in Table 3, it was revealed that the mordants according to the present invention provide yellow images of high transfer density and also greatly improve light-fastness of the transferred dye images.

Examples wherein the mordant of the present invention is used in combination with a zinc compound are given below.

EXAMPLE 4

To 160 ml of distilled water were added 0.75 g of the aforesaid gelatin hardener H-1, 0.25 g of the aforesaid gelatin hardener H-2 and 0.7 g of zinc acetate, and 100 g of a 10% aqueous solution of acid-processed gelatin was added thereto, followed by uniformly mixing. The resulting mixture was uniformly coated on a paper support laminated with polyethylene having dispersed therein titanium oxide to a wet thickness of 60 μm and dried. A uniform mixture consisting of 10 g of a mordant P-1, 200 ml of distilled water and 100 g of a 10% aqueous solution of lime-processed gelatin was uniformly coated on the above obtained coating and dried to prepare Dye Fixing Material (E) containing Mordant P-1.

Dye-Fixing Material (F) was prepared in the same manner as described above except for using Mordant P-4 in place of Mordant P-1.

Each of the aforesaid Dye-Fixing Materials (A) to (C) and the above prepared Dye-Fixing Materials (E) and (F) was treated and tested in the same manner as described in Example 1, and the results obtained are shown in Table 4.

TABLE 4

| Dye-Fixing Material | Mordant | Maximum Density | Dye Remaining Ratio (I) (%) | Dye Remaining Ratio (II) (%) | Remark |
|---|---|---|---|---|---|
| (A) | HP-1 | 1.80 | 64 | 70 | Comparison |
| (B) | HP-2 | 1.92 | 54 | 73 | " |
| (C) | P-1 | 2.00 | 66 | 99 | Invention |
| (E) | P-1 | 2.18 | 64 | 100 | " |
| (F) | P-4 | 2.20 | 53 | 98 | " |

As is apparent from Table 4, the combined use of the mordant of the present invention and a zinc compound provides a cyan image having further increased transfer density. It can further be seen that fastness of the dye images to high temperatures and humidities can also be noticeably improved in this example similarly to Example 1.

EXAMPLE 5

The same procedures as described in Example 1 were repeated except for using Dye-Fixing Materials (A) to (C) prepareed in Example 1 and (E) and (F) prepared in Example 4 and using the light-sensitive coating as used in Example 2. The results obtained are shown in Table 5.

TABLE 5

| Dye-Fixing Material | Mordant | Maximum Density | Dye Remaining Ratio (I) (%) | Remark |
|---|---|---|---|---|
| (A) | HP-1 | 1.90 | 73 | Comparison |
| (B) | HP-2 | 1.96 | 68 | " |
| (C) | P-1 | 2.10 | 92 | Invention |
| (E) | P-1 | 2.30 | 93 | " |
| (F) | P-4 | 2.35 | 81 | " |

It can be seen from Table 5 that the combined use of the mordants according to the present invention and zinc compounds provide magenta dye images having further increased transfer densities. In this example too, fastness of the transferred dye images to light could be markedly improved.

The following example describes a photographic system wherein the mordants according to the present invention were used but the layer structure and the processing procedures were different from those of Examples 1 to 5.

EXAMPLE 6

Onto a polyethylene terephthalate support having dispersed therein titanium oxide were coated the following layers in the order given to prepare Dye-Fixing Materials (G) (wherein Mordant HP-1 was used) and (H) (wherein Mordant HP-2 was used).

(1) Subbing Layer

A layer formed by uniformly coating a uniform mixture consisting of 80 g of a 10% aqueous solution of polyvinyl alcohol (degree of saponification: 98%), 40 g of a 20% aqueous solution of polyacrylic acid and 400 ml of water to a wet thickness of 70 μm.

(2) Hydrophilic Thermal Solvent Layer

A layer formed by coating the following composition to a wet thickness of 90 μm.

(a) Urea: 30 g (b) N-Methylurea: 40 g (c) Water: 190 ml (d) 10% Aqueous solution of polyvinyl alcohol (degree of saponification: 98%): 200 g (e) 5% Aqueous solution of Compound AA having the following formula:

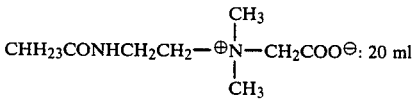

(f) Mordant HP-1 or HP-2: 20 g

Dye-Fixing Material (I) was prepared in the same manner as described above except that Mordant P-1 was used in place of Mordant HP-1 or 2 and Gelatin Hardeners H-1 and H-2 were used in the subbing layer in amounts of 1.5 g and 0.5 g, respectively.

Further, Dye-Fixing Material (J) was prepared in the same manner as described above except for using Mordant P-4 in place of Mordant P-1.

The light-sensitive coating used in this example was prepared in the same manner as in Example 1.

The above-described light-sensitive coating was imagewise exposed to light for 10 seconds using a tungsten lamp of 2,000 lx. Thereafter, the exposed coating was uniformly heated on a heating block heated at 140° C. for 20 seconds.

The heated light-sensitive coating and each of the dye-fixing materials were overlapped with the respective coating film surfaces facing to each other. After the system was heated under pressure for 40 seconds while being passed through a pair of hot rollers set at 130° C., the dye-fixing material was peeled apart from the light-sensitive material. There was obtained a cyan dye image positive to the silver image on the dye-fixing material. The density of the thus obtained negative image to green light was measured by means of a Macbeth reflection densitometer (RD 519).

The negative image was evaluated for fastness to high temperature and humidity by determining Dye Remaining Ratio II according to the same manner as in Example 1. The maximum density and the Dye Remaining Ratio II at a reflection density of 1.0 are shown in Table 6.

TABLE 6

| Dye-Fixing Material | Mordant | Maximum Density | Dye Remaining Ratio II (%) | Remark |
|---|---|---|---|---|
| (G) | HP-1 | 1.74 | 68 | Comparison |
| (H) | HP-2 | 1.81 | 65 | " |
| (I) | P-1 | 1.94 | 99 | Invention |
| (J) | P-4 | 2.01 | 98 | " |

As shown in Table 6, it can be seen that the mordants according to the present invention provide cyan dye images of high transfer density and greatly improve fastness of the images to high temperature and humidity.

EXAMPLE 7

The same procedures as described in Example 6 except that the cyan dye-donating compound was replaced by the magenta dye-donating compound as used in Example 2 were repeated to obtain the results shown in Table 7.

TABLE 7

| Dye-Fixing Material | Mordant | Maximum Density | Dye Remaining Ratio I (%) | Remark |
|---|---|---|---|---|
| (G) | HP-1 | 1.67 | 75 | Comparison |
| (H) | HP-2 | 1.74 | 66 | " |
| (I) | P-1 | 1.84 | 91 | Invention |
| (J) | P-4 | 1.93 | 82 | " |

As is shown in Table 7, it can be seen that the mordants according to the present invention provide magenta dye images of high transfer density and greatly improve light-fastness of the transferred magenta images.

EXAMPLE 8

The same procedures as in Example 6 except that the cyan dye-donating compound as used in the light-sensitive coating of Example 6 was replaced by the yellow dye-donating compound as used in Example 3 were repeated. The results obtained are shown in Table 8.

TABLE 8

| Dye-Fixing Material | Mordant | Maximum Density | Remark |
|---|---|---|---|
| (G) | HP-1 | 1.71 | Comparison |
| (H) | HP-2 | 1.79 | " |
| (I) | P-1 | 1.81 | Invention |
| (J) | P-4 | 1.90 | " |

The above-described Examples 1 to 8 prove that the mordants according to the present invention provide images having high transfer densities from any of cyan, magenta and yellow dyes in a color image-forming process wherein development is carried out by heat-treatment, and greatly improve fastness of the transferred cyan dye images under high temperature and humidity condition and fastness of magenta and yellow dye images under light irradiation.

Further, it is also proved that the mordants of the present invention have an excellent characteristic that when they are used in combination with a zinc compound, they further heighten the transfer densities of the dye images while retaining the above-described excellent properties.

The hereinafter given example shows the use of the mordants of the present invention in color light-sensitive materials of diffusion transfer type which are developed by a developing solution at temperatures around room temperature.

EXAMPLE 9

Preparation of Light-Sensitive Sheet

The following layers (1) to (12) were coated in this order onto a polyethylene terephthalate transparent support.

(1) A mordant layer containing 3.0 g/m$^2$ of Mordant HP-3 having the following formula and 3.0 g/m$^2$ of gelatin.

Mordant HP-3

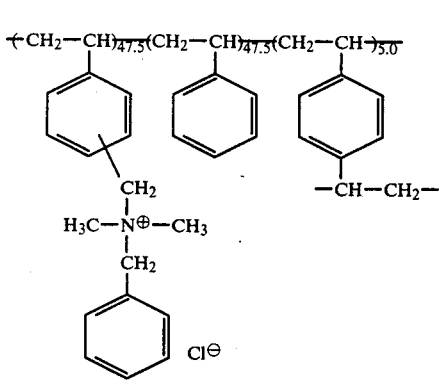

(2) A white reflecting layer containing 20 g/m$^2$ of titanium oxide and 2.0 g/m$^2$ of gelatin.

(3) A light-screening layer containing 2.3 g/m$^2$ of carbon black and 3.1 g/m$^2$ of gelatin.

(4) A layer containing 1.6 g/m$^2$ of N,N-diethyllaurylamide having dissolved therein 0.96 g/m$^2$ of a cyan dye-donating compound having the following structure and 0.03 g/m$^2$ of 2,5-di-t-butylhydroquinone, and 1.5 g/m$^2$ of gelatin.

Cyan Dye-Donating Compound:

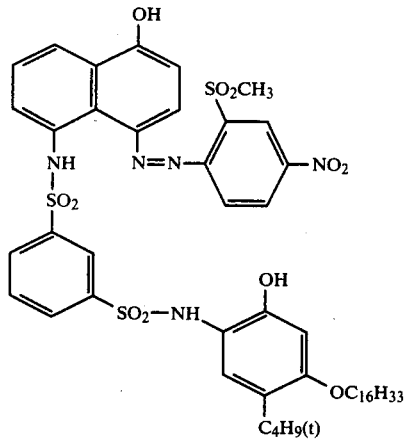

(5) A red-sensitive emulsion layer containing an internal latent image type direct reversal emulsion of silver iodobromide containing 1.9 g/m$^2$ of silver which had been spectrally sensitized to red (the same as the emulsion of Example 1 of U.S. Pat. No. 4,094,683), 0.040 g/m$^2$ of 3-(2-formylethyl)-2-methyl-benzothiazolium bromide and 1.4 g/m$^2$ of gelatin.

(6) An intermediate layer containing 3.3 g/m$^2$ of gelatin, 0.030 g/m$^2$ of sodium hydrogensulfite, 1.9 g/m$^2$ of tricresyl phosphate and 1.2 g/m$^2$ of 2,5-di-t-octylhydroquinone dissolved in a mixture of 1.9 g/m$^2$ of tricresyl phosphate and 0.77 g/m$^2$ of dibutyl phosphate.

(7) A layer containing 1.5 g/m$^2$ of gelatin and 1.5 g/m$^2$ of N,N-diethyllaurylamide having dissolved therein 0.89 g/m$^2$ of a magenta dye-donating compound having the following structure and 0.030 g/m$^2$ of 2,5-di-t-butylhydroquinone.

Magenta Dye-Donating Compound:

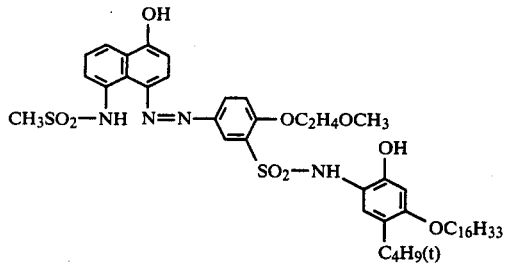

(8) A green-sensitive emulsion layer containing an internal latent image type direct reversal emulsion of silver iodobromide containing 1.4 g/m$^2$ of silver which had been spectrally sensitized to green light (the same as the emulsion of Example 1 of U.S. Pat. No. 4,094,683), 0.010 g/m$^2$ of 3-(2-formylethyl)-2-methyl-benzothiazolium bromide and 1.0 g/m$^2$ of gelatin.

(9) An intermediate layer containing 3.7 g/m$^2$ of gelatin, 0.023 g/m$^2$ of sodium hydrogensulfite and 0.94 g/m$^2$ of 2,5-di-t-octylhydroquinone dissolved in a mixed solvent of 1.5 g/m$^2$ of tricresyl phosphate and 0.61 g/m$^2$ of dibutyl phthalate.

(10) A layer containing 2.9 g/m$^2$ of gelatin and 2.5 g/m$^2$ of N,N-diethyllaurylamide having dissolved therein 1.5 g/m$^2$ of a yellow dye-donating compound having the following structure and 0.042 g/m$^2$ of 2,5-di-t-butylhydroquinone.

Yellow Dye-Donating Compound:

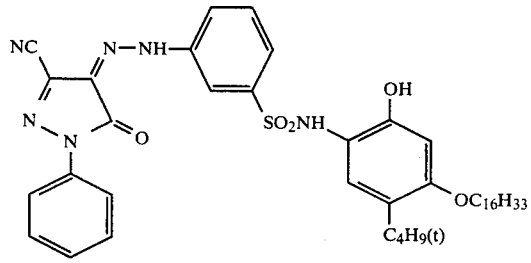

(11) A blue-sensitive emulsion layer containing a blue-sensitive internal latent image type direct reversal emulsion of silver iodobromide containing 2.2 g/m$^2$ of silver (the same as the emulsion of Example 1 of U.S. Pat. No. 4,094,683), 0.014 g/m$^2$ of 3-(2-formylethyl)-2-methyl-benzothiazolium bromide and 1.7 g/m$^2$ of gelatin.

(12) A gelatin protecting layer containing 0.95 g/m$^2$ of gelatin.

Preparation of Cover Sheet

A cover sheet was prepared by coating a polyethylene terephthalate support with a neutralizing acidic polymer layer containing 15 g/m$^2$ of polyacrylic acid (viscosity: ca. 1,000 cps as a 10% aqueous solution) and further coating thereon a neutralization timing layer containing 3.8 g/m$^2$ of acetyl cellulose having such an acetyl value that hydrolysis of a 100 g sample gives 39.4 g of acetic acid, and 0.2 g/m$^2$ of poly(styrene-comalic anhydride) (styrene: maleic anhydride=about 60:40 molar ratio; molecular weight=about 50,000).

Developing Solution 1-p-Tolyl-4-hydroxymethyl-4-methyl-3-pyrazolidone: 8 g
Methylhydroquinone: 0.3 g
5-Methylbenzotriazole: 3.5 g
Anhydrous sodium sulfite: 0.2 g
Sodium carboxymethyl cellulose: 58 g
Carbon black: 150 g
Potassium hydroxide: 56 g
Water to make 1 liter The above-described developing solution was developed between the light-sensitive sheet and the cover sheet. Dye Remaining Ratio I of the resulting dye image was obtained in the same manner as described in Example 1 to evaluate fastness to light.

Further, the same procedures as described above except for using Mordant P-1 or P-4 in place of HP-3 were repeated, and the results obtained are shown in Table 9.

TABLE 9

| Mordant | Dye Remaining Ratio (I) (%) Cyan | Magenta | Yellow | Remark |
|---|---|---|---|---|
| HP-3 | 14 | 17 | 48 | Comparison |
| P-1 | 68 | 91 | 86 | Invention |
| P-4 | 55 | 82 | 74 | " |

From Table 9, it can be seen that the mordants of the present invention greatly improve light-fastness of dye images in color light-sensitive materials of diffusion transfer type wherein a developing solution is used at temperature around room temperature.

While the invention has been described in detail and with reference to specific embodiments thereof, it will be apparent to one skilled in the art that various change and modifications can be made therein without departing from the spirit and scope thereof.

What is claimed is:

1. A photographic element, comprising: a support, at least one silver halide light-sensitive emulsion having associated therewith a dye-donating compound which is capable of imagewise forming a dye and an image-receiving layer containing as a mordant, a polymer comprising a monomer unit having at least an imidazole ring represented by the formula (I) and a monomer unit having at least a sulfinic acid group represented by the formula (II):

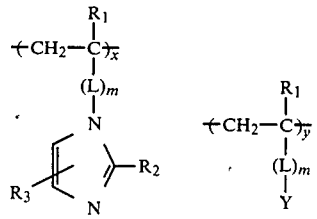

(I) (II)

wherein $R_1$, $R_2$ and $R_3$ each represents a hydrogen atom or an alkyl group having 1 to 6 carbon atoms; L represents a divalent linking group having 1 to 20 carbon atoms; m represents 0 or 1; Y represents a sulfinic acid group or a sulfinic acid group in the form of a salt; x represents 10 to 98 mol%; and y represents 2 to 40 mol%; and wherein said mordant is a mordant for fixing dyes in a color formation process in which diffusible dyes are imagewise formed and then diffused, followed by fixing.

2. A photographic element as claimed in claim 1, wherein the image forming dye which is mordanted by the polymeric mordant is a phthalocyanine dye having an anionic group.

3. A photographic element as claimed in claim 2, wherein in the formula (I), $R_1$, $R_2$ and $R_3$ each represents a hydrogen atom, a methyl group or an ethyl group.

4. A photographic element as claimed in claim 2, wherein in the formula (I) or (II), L represents an alkylene group, a phenylene group, an arylenealkylene group, $-CO_2-$, $-CO_2-R_5-$ (wherein $R_5$ represents an alkylene group, a phenylene group or an arylenealkylene group) or

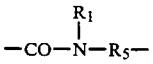

(wherein $R_1$ represents a hydrogen atom or an alkyl group having 1 to 6 carbon atoms; and $R_5$ is as defined above).

5. A photographic element as claimed in claim 4, wherein in the formula (I), L represents

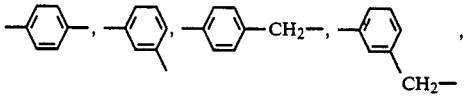

$-CO_2-$, $-CONH-$, $-CO_2CH_2CH_2-$, $-CO_2CH_2CH_2CH_2-$, $-CONHCH_2-$, $-CONHCH_2CH_2-$ or $-CONHCH_2CH_2CH_2-$.

6. A photographic element as claimed in claim 2, wherein in the formula (II), $R_1$ represents a hydrogen atom or a methyl group.

7. A photographic element as claimed in claim 4, wherein in the formula (II), L represents

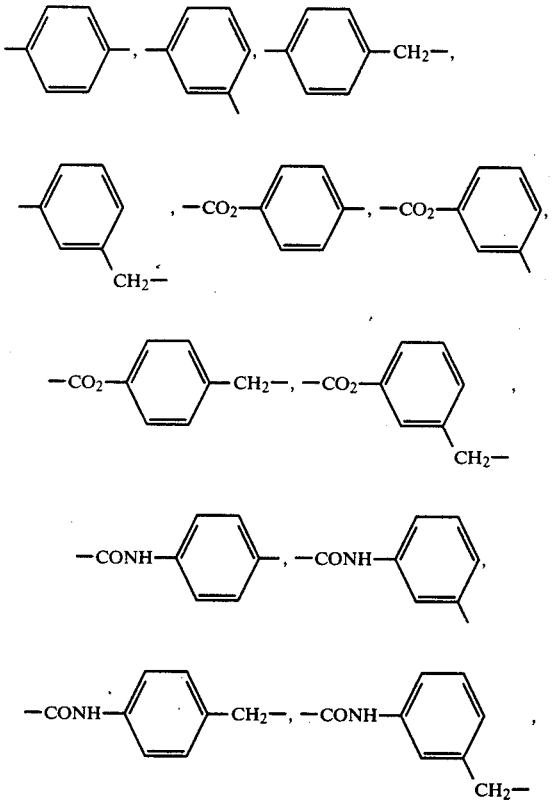

-continued $-CO_2CH_2CH{=}CHCH_2-$, or $-CONHCH_2CH{=}CHCH_2-$.

8. A photographic element as claimed in claim 2, wherein in the formula (II), the cation which forms the sulfinic acid salt is an ammonium ion, a sodium ion or a potassium ion.

9. A photographic element as claimed in claim 1, wherein the polymer comprises 40 to 98 mol% of the monomer unit having at least an imidazole ring and 2 to 30 mol% of the monomer unit having at least a sulfinic acid group.

10. A photographic element as claimed in claim 1, wherein the polymer comprises 50 to 90 mol% of the monomer unit having at least an imidazole ring and 5 to 25 mol% of the monomer unit having at least a sulfinic acid group.

11. A photographic element as claimed in claim 1, wherein the polymer has a molecular weight of from $5\times10^3$ to $1\times10^7$.

12. A photographic element as claimed in claim 1, wherein the photographic element further comprises metal ion which is located in a layer containing said mordant or an upper or lower layer adjacent thereto and the polymer mordant is used in combination with the metal ion.

13. A photographic element as claimed in claim 12, wherein the metal ion is $Cu^{2+}$, $Zn^{2+}$, $Ni^{2+}$, $Pt^{2+}$, $Pd^{2+}$ or $Co^{3+}$.

14. A photographic element as claimed in claim 12, wherein the metal ion is $Zn^{2+}$.

15. A photographic element as claimed in claim 12, wherein the metal ion is added in the form of a water-soluble compound in an amount of from 0.01 to 5 g/m$^2$.

16. A photographic element as claimed in claim 15, wherein the metal ion is added in the form of a water-soluble compound in an amount of from 0.1 to 1.5 g/m$^2$.

* * * * *